United States Patent [19]

Koster et al.

[11] 4,291,712

[45] Sep. 29, 1981

[54] CIGARETTE FILTER AND FILTER CIGARETTE

[75] Inventors: Hendrikus J. Koster, Koude kerk a/d Rijn; Johannes T. J. Bik; Johannes G. Clardey, both of Rijswijk; Dirk Smorenberg, Berkel Roodenrijs, all of Netherlands

[73] Assignee: Sigarettenfabriek Ed. Laurens B.V., The Hague, Netherlands

[21] Appl. No.: 959,173

[22] Filed: Nov. 9, 1978

[30] Foreign Application Priority Data

Nov. 11, 1977 [NL] Netherlands ..... 7712441

[51] Int. Cl.[3] ..... A24D 3/02; A24D 3/04; A24C 5/52

[52] U.S. Cl. ..... 131/339; 131/94; 493/39

[58] Field of Search ..... 131/10 A, 10.3, 10.5, 131/10.7, 10.9, 261 R, 261 B, 88, 94; 219/121 C, 121 LM; 93/1 C, 77 FT

[56] References Cited

U.S. PATENT DOCUMENTS

| | | | |
|---|---|---|---|
| 3,389,705 | 6/1968 | Levane | 131/10.5 |
| 3,411,512 | 11/1968 | Johnson | 131/10.5 |
| 3,496,945 | 2/1970 | Tomkin | 131/10.5 |
| 3,527,235 | 9/1970 | Fidelman | 131/10.5 |
| 3,596,663 | 8/1971 | Schultz | 131/10 A |
| 3,685,523 | 8/1972 | Labbe | 131/10.5 |
| 4,109,666 | 8/1978 | Norman et al. | 131/261 B |

OTHER PUBLICATIONS

"Precise Perforations Every Time", by Silvus et al. cited from *The Tool and Manufacturing Engineer* magazine, Nov. 1969 issue pp. 46–49.

"Taming the Laser for Industry", by *Factory* magazine cited from the Apr. 1962 issue, pp. 96 and 97 cited.

*Primary Examiner*—V. Millin

*Attorney, Agent, or Firm*—Brooks Haidt Haffner & Delahunty

[57] ABSTRACT

A filter to be mounted to a cigarette and provided with one or more axial channels made by means of a laser beam, as well as a cigarette provided with such a filter.

8 Claims, 3 Drawing Figures

CIGARETTE FILTER AND FILTER CIGARETTE

Figure 1:
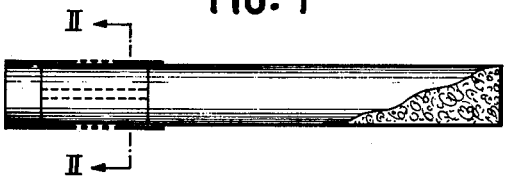

It is known that the composition of tobacco smoke can be modified favourably to the smoker's health by mounting a filter to a cigarette. However, a drawback of the existing "low condensate and nicotine" filters which are made of a so-called fine cable, e.g. 2.5D/65000, and may have a retention of up to 70% is that of the smoke passed (i.e. 30% or more of the total) only the greater dispersed particles are restrained while the smaller particles are passed, as a result of which the flavour relative to that of a cigarette without filter is changed completely. To meet this drawback, there have been developed cigarette filters wherein is provided an axial channel. This has the advantage that, at least in part, the total particle range comes in the smoker's mouth, so that the flavour is weakened but not deformed. In a known construction, the channel is formed by a tube of plastics applied in the filter in axial (and preferably central) direction. However, this construction has drawbacks in that during production it is difficult to apply the tube of plastics exactly centred and in the desired position inside the filter and, moreover, at the ends the ends of the filter fibers bend over the tube, so that it is partly closed. In addition, the tube may be deformed when the filter rods are cut to ready filters.

Now, the invention consists herein that in the filter are applied one or more channels by means of a laser beam. A filter thus produced has the advantages of the above-mentioned filter, but not the drawbacks. The channels can be made exactly axially, they retain their fixed position in the filter during following manipulations with the filter or cigarette, and, moreover, they cannot become closed because the filter material in the position where the laser beam has acted is evaporated completely and no incinerated or charred remnants are present but only a hardened inner wall resulting from the melting of the filter material, which inner wall resists flattening when subsequently the filter rods are cut to ready filters.

Moreover, the channels have a constant diameter over their entire length owing to the exactly constant diameter of the laser beam that acted on the filter.

In practice, good results have been obtained with four channels of 0.5 mm diameter each or with one channel of 1 mm diameter in a filter of conventional diameter.

The channels to be applied by the laser beam need not necessarily have a circular cross-section; the cross-section may have any form and, for example, may also be rectangular.

In a practical embodiment of the method, the channels can be properly made in the filter by means of a laser machine positioned after a so-called filter rod machine. The ready filter rods originating from the filter rod machine and having mostly a six-fold filter length are then exposed to the laser beam (or laser beams) prior to being cut to filters by means of a rotating circular knife or to being supplied to a filter mounting machine. As laser machine can be employed a suitable commercial high-power laser machine, e.g. a High-Power Infrared Laser (Philips, Holland) or an Everlase-150 (Coherent Radiation, U.S.A., supplied by R.M.P., Hilversum), both of which are so-called $CO_2$ lasers. In this case an inert gas, such as nitrogen, supplied concentrically with the focused radiation beam by means of a nozzle sees to blowing away molten or evaporated material, to cooling the edges and the surroundings of the operation position, and to cooling the lens mounted in the nozzle. Thus, it appeared to be possible by means of a focused radiation beam originating from the above-mentioned High-Power Infrared Laser (Philips) working in $TEM_{00}$ mode with a power of 34 W to burn in 12 cm long filter rods holes of a diameter ranging from 1.3 mm to 0.9 mm in times ranging from 0.3 to 1 sec. As known, laser stands for "light amplification by stimulated emission of radiation".

In the production of the filters according to the invention it is recommendable to produce double filters by mounting to the filter provided with one or more channels yet a short normal non-perforated filter. This is advantageous in that at the outside the channel or channels are not visible nor perceptible to touch. For that matter, in the known filters the tube of plastics did not extend to the end of the filter destined for the mouth either. Moreover, then there is a possibility to use a different filter material for the filter to be mounted or, if necessary, to have it consist of tobacco.

Normally, the filter is made of cellulose acetate fiber, which is impregnated with a plasticizer. Herein, the tensile resistance and hence the activity of the filter can be modified in a known manner by choosing the number of monofilaments of the polyester "tow" used, the denier of the monofilaments and the cross-section of the monofilaments. However, the filter can also be made of paper or cellulose. In addition to the fibrous material, the filter may furthermore comprise yet in a known manner specific additives, by means of which is obtained a selective activity for specific components of the smoke or the particle phase. Finally, it is recommendable for the production of the filter to use in a known manner a tip paper having line or zone perforation. As a result, the smoke is proportionately diluted with air when the cigarette is being drawn.

The invention is further explained with reference to the drawings, wherein

Figure 2:
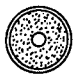
Figure 3:
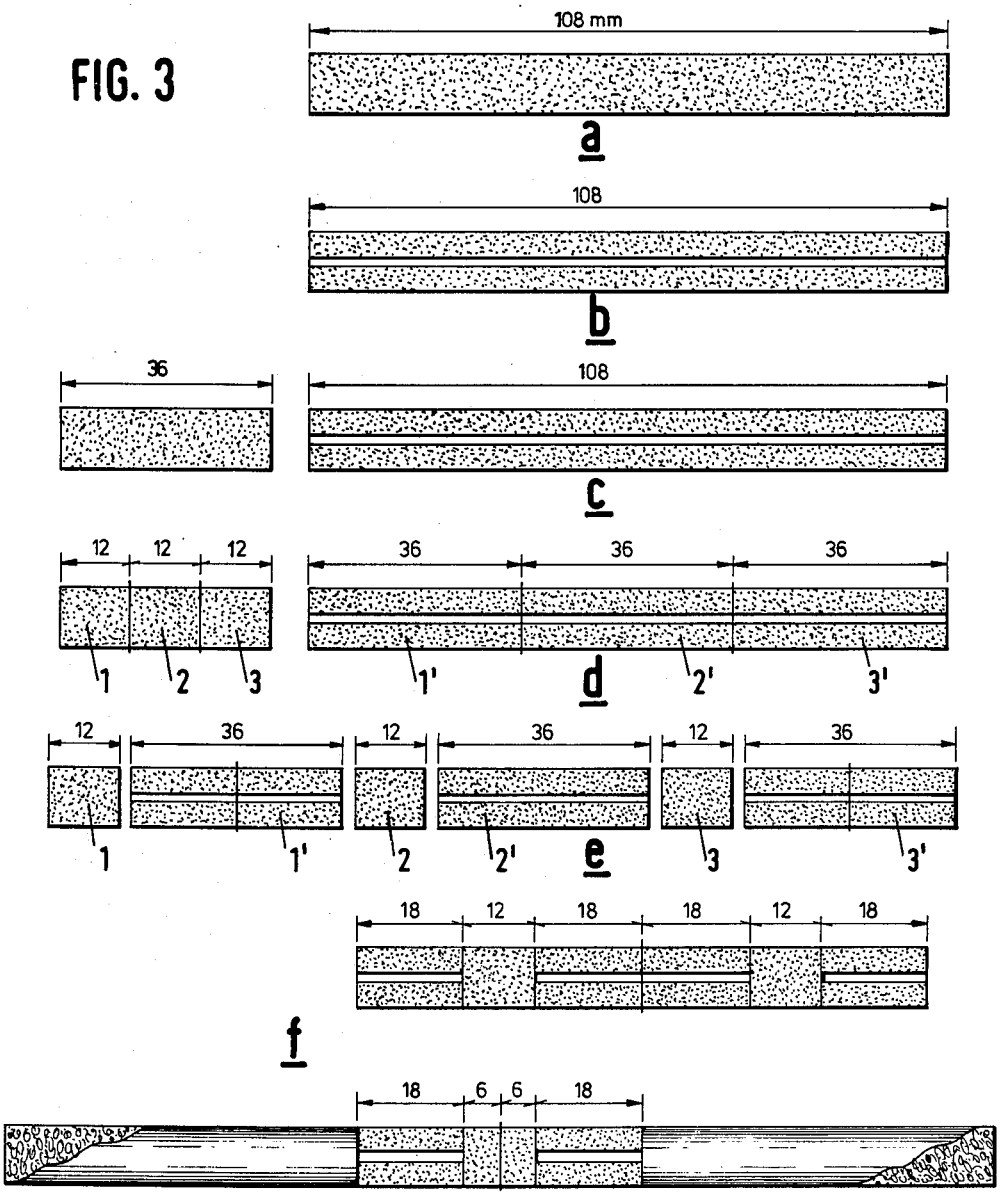

FIG. 1 represents in cross-section a filter cigarette according to a preferred embodiment of the invention, FIG. 2 shows a cross-section through said cigarette on line II—II, and FIG. 3 schematically shows the production of a so-called double filter according to the invention.

A normal acetate filter rod having a length of 108 mm (a) is exposed to a laser beam from a laser unit, as a result of which a central channel is burnt into it (b).

Together with a normal (non-perforated) acetate filter rod of 36 cm the perforated acetate rod is fed to a so-called double rod machine (c) and thereon cut into three equal portions (d).

These portions are laid alternately in one strand, covered with "plug wrap paper", and subsequently cut to a length of 96 mm (e). The filter rods of 96 mm are subsequently processed to filter cigarettes on a Molins or Hauni assembling machine, which is coupled to a cigarette machine. The rod of 96 mm is first cut into two parts of 48 mm each, then mounted between two cigarettes, and subsequently cut in two (f).

We claim:

1. A method of making a filter to be mounted on a cigarette, in which filter there is provided at least one axial channel comprising providing a rod of fibrous material and burning therethrough one or more channels by means of a laser beam.

2. A method according to claim 1 making a double filter, characterized by mounting to filter provided with one or more channels a normal non-perforated filter.

3. A method of making filter cigarettes by mounting a filter on a cigarette, characterized by using a filter according to claim 1 or 2.

4. A cigarette filter comprising a body of fibrous material enclosed in a wrapping material, said fibrous material having one or more axial channels therethrough with a hardened inner channel wall resulting from the melting of the filter material by producing the filter by laser means.

5. A cigarette filter rod to be cut into cigarette filters comprising an elongated body of fibrous material enclosed in a wrapping material with one or more axial channels through the body of fibrous material having a hardened inner channel wall resulting from melting of the fibrous material by burning the channel through the fibrous material by laser means.

6. A cigarette double filter comprising a body of fibrous material enclosed in a wrapping material in which the portion of the filter to be attached to a cigarette has one or more axial channels with a hardened inner channel wall resulting from melting the filter material in producing the channel by laser means.

7. A cigarette filter according to claim 4, 5 or 8 wherein the fibrous material is cellulose acetate.

8. A cigarette provided with a filter according to claim 4 or 6.

* * * * *